US008423170B2

(12) United States Patent
Hirose et al.

(10) Patent No.: US 8,423,170 B2
(45) Date of Patent: Apr. 16, 2013

(54) SEWING MACHINE AND COMPUTER-READABLE MEDIUM STORING A PROGRAM FOR SEWING BUTTONHOLE

(75) Inventors: Hirokazu Hirose, Chiryu (JP); Yuki Ihira, Kakamigahara (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 948 days.

(21) Appl. No.: 12/457,456

(22) Filed: Jun. 11, 2009

(65) Prior Publication Data

US 2009/0312861 A1 Dec. 17, 2009

(30) Foreign Application Priority Data

Jun. 12, 2008 (JP) ..... 2008-153753

(51) Int. Cl.
*G06F 7/66* (2006.01)

(52) U.S. Cl.
USPC ..... 700/136; 112/447; 112/449; 112/470.03

(58) Field of Classification Search ..... 700/136, 700/137; 112/235, 314, 446–449, 470.03
See application file for complete search history.

(56) References Cited

U.S. PATENT DOCUMENTS

| | | | | |
|---|---|---|---|---|
| 4,182,249 | A | 1/1980 | Matumura et al. | |
| 4,216,732 | A * | 8/1980 | Marsh et al. | 112/447 |
| 4,242,976 | A * | 1/1981 | Beckerman et al. | 112/475.25 |
| 4,343,249 | A * | 8/1982 | Takenoya et al. | 112/314 |
| 4,458,612 | A | 7/1984 | Asai et al. | |
| 4,658,741 | A | 4/1987 | Jehle et al. | |
| 4,953,486 | A * | 9/1990 | Sano et al. | 112/447 |
| 5,904,108 | A * | 5/1999 | Tanaka et al. | 112/102.5 |
| 7,299,757 | B2 | 11/2007 | Niizeki et al. | |
| 7,392,755 | B2 | 7/2008 | Kato et al. | |
| 2006/0015209 | A1 | 1/2006 | Schweizer | |
| 2008/0066665 | A1 | 3/2008 | Asaba et al. | |

FOREIGN PATENT DOCUMENTS

| | | |
|---|---|---|
| JP | A-54-76348 | 6/1979 |
| JP | U-54-119760 | 8/1979 |
| JP | A-54-121866 | 9/1979 |
| JP | A-59-57689 | 4/1984 |
| JP | A-59-62083 | 4/1984 |
| JP | A-62-14888 | 1/1987 |
| JP | A-2-172494 | 7/1990 |
| JP | A-7-16376 | 1/1995 |
| JP | A-8-141235 | 6/1996 |
| JP | A-9-187586 | 7/1997 |
| JP | A-2001-293271 | 10/2001 |
| JP | A-2002-282566 | 10/2002 |
| JP | A-2006-346087 | 12/2006 |
| JP | A-2007-252616 | 10/2007 |
| JP | A-2008-61712 | 3/2008 |

OTHER PUBLICATIONS

Jul. 27, 2010 Office Action issued in Japanese Patent Application No. 2008-153753 (with translation).

* cited by examiner

*Primary Examiner* — Nathan Durham
(74) *Attorney, Agent, or Firm* — Oliff & Berridge, PLC

(57) ABSTRACT

A sewing machine that includes an image capturing device and a sewing device. The image capturing device captures an image, and the sewing device sews a buttonhole having a length in accordance with a shape of the button, based on an image of a button captured by the image capturing device.

4 Claims, 14 Drawing Sheets

FIG. 7

| DATA NO. | FEED PITCH | NEEDLE BAR SWINGING PITCH | LOOP FLAG |
|---|---|---|---|
| 1 | 0 | 150 | 0 |
| 2 | 0 | 0 | 0 |
| 3 | -108 | -175 | 0 |
| 4 | -90 | -175 | 1 |
| 5 | -90 | -175 | 2 |
| 6 | 0 | -150 | 0 |
| 7 | 90 | -150 | 1 |
| 8 | 90 | -150 | 2 |
| 9 | -36 | -50 | 0 |
| 10 | 216 | 0 | 0 |
| 11 | -216 | -25 | 0 |
| 12 | 198 | -100 | 0 |
| 13 | -198 | -50 | 0 |
| 14 | 126 | -175 | 0 |
| 15 | -162 | -50 | 0 |
| 16 | 72 | -225 | 0 |
| 17 | -108 | -50 | 0 |
| 18 | 0 | -250 | 0 |
| 19 | -54 | -50 | 0 |
| 20 | -54 | -250 | 1 |
| 21 | -54 | -50 | 2 |
| 22 | 0 | 150 | 0 |
| 23 | 90 | 150 | 1 |
| 24 | 90 | 150 | 2 |
| 25 | -36 | 50 | 0 |
| 26 | 216 | 0 | 0 |
| ⋮ | ⋮ | ⋮ | ⋮ |

FIG. 8

| DATA NO. | FEED PITCH | NEEDLE BAR SWINGING PITCH | LOOP FLAG |
|---|---|---|---|
| ⋮ | ⋮ | ⋮ | ⋮ |
| 27 | -216 | 25 | 0 |
| 28 | 198 | 100 | 0 |
| 29 | -198 | 50 | 0 |
| 30 | 126 | 175 | 0 |
| 31 | -162 | 50 | 0 |
| 32 | 72 | 225 | 0 |
| 33 | -108 | 50 | 0 |
| 34 | 0 | 250 | 0 |
| 35 | -54 | 50 | 0 |
| 36 | -54 | 250 | 1 |
| 37 | -54 | 50 | 2 |
| 38 | -72 | -250 | 0 |
| 39 | 18 | 250 | 0 |
| 40 | 36 | -250 | 0 |
| 41 | 36 | 250 | 0 |
| 42 | 36 | -250 | 0 |
| 43 | 36 | 250 | 0 |
| 44 | 0 | -250 | 0 |
| 45 | -36 | -250 | 0 |
| 46 | -36 | -250 | 0 |
| 47 | 108 | -250 | 0 |

FIG. 12

| POINTER | | COORDINATES ON WORK CLOTH | |
|---|---|---|---|
| P1 | P2 | Y-COORDINATE | X-COORDINATE |
| 1 | 0 | 0 | 150 |
| 2 | 0 | 0 | 0 |
| 3 | 0 | 108 | -175 |
| 4 | 4 | 198 | -175 |
| 5 | 4 | 288 | -175 |
| 4 | 4 | 378 | -175 |
| 5 | 4 | 468 | -175 |
| 4 | 4 | 558 | -175 |
| 5 | 4 | 648 | -175 |
| 4 | 4 | 738 | -175 |
| 5 | 4 | 828 | -175 |
| 4 | 4 | 918 | -175 |
| 5 | 4 | 1008 | -175 |
| 4 | 4 | 1098 | -175 |
| 5 | 4 | 1188 | -175 |
| 4 | 4 | 1278 | -175 |
| 5 | 4 | 1368 | -175 |
| 4 | 4 | 1458 | -175 |
| 5 | 4 | 1548 | -175 |
| 4 | 4 | 1638 | -175 |
| 5 | 4 | 1728 | -175 |
| 4 | 4 | 1818 | -175 |
| 5 | 4 | 1908 | -175 |
| ⋮ | ⋮ | ⋮ | ⋮ |

FIG. 13

| POINTER | | COORDINATES ON WORK CLOTH | |
|---|---|---|---|
| P1 | P2 | Y-COORDINATE | X-COORDINATE |
| ⋮ | ⋮ | ⋮ | ⋮ |
| 4 | 4 | 1998 | -175 |
| 5 | 4 | 2088 | -175 |
| 4 | 4 | 2178 | -175 |
| 5 | 4 | 2268 | -175 |
| 6 | 4 | 2268 | -150 |
| 7 | 7 | 2178 | -150 |
| 8 | 7 | 2088 | -150 |
| 7 | 7 | 1998 | -150 |
| 8 | 7 | 1908 | -150 |
| 7 | 7 | 1818 | -150 |
| 8 | 7 | 1728 | -150 |
| 7 | 7 | 1638 | -150 |
| 8 | 7 | 1548 | -150 |
| 7 | 7 | 1458 | -150 |
| 8 | 7 | 1368 | -150 |
| 7 | 7 | 1278 | -150 |
| 8 | 7 | 1188 | -150 |
| 7 | 7 | 1098 | -150 |
| 8 | 7 | 1008 | -150 |
| 7 | 7 | 918 | -150 |
| 8 | 7 | 828 | -150 |
| 7 | 7 | 738 | -150 |
| 8 | 7 | 648 | -150 |
| 7 | 7 | 558 | -150 |
| 8 | 7 | 468 | -150 |
| 7 | 7 | 378 | -150 |
| 8 | 7 | 288 | -150 |
| ⋮ | ⋮ | ⋮ | ⋮ |

FIG. 14

| POINTER | | COORDINATES ON WORK CLOTH | |
|---|---|---|---|
| P1 | P2 | Y-COORDINATE | X-COORDINATE |
| ⋮ | ⋮ | ⋮ | ⋮ |
| 7 | 7 | 198 | -150 |
| 8 | 7 | 108 | -150 |
| 9 | 7 | 144 | -50 |
| 10 | 7 | -72 | 0 |
| 11 | 7 | 216 | -25 |
| 12 | 7 | 18 | -100 |
| 13 | 7 | 216 | -50 |
| 14 | 7 | 90 | -175 |
| 15 | 7 | 252 | -50 |
| 16 | 7 | 180 | -225 |
| 17 | 7 | 288 | -50 |
| 18 | 7 | 288 | -250 |
| 19 | 7 | 342 | -50 |
| 20 | 20 | 396 | -250 |
| 21 | 20 | 450 | -50 |
| 20 | 20 | 504 | -250 |
| 21 | 20 | 558 | -50 |
| 20 | 20 | 612 | -250 |
| 21 | 20 | 666 | -50 |
| 20 | 20 | 720 | -250 |
| ⋮ | ⋮ | ⋮ | ⋮ |

SEWING MACHINE AND COMPUTER-READABLE MEDIUM STORING A PROGRAM FOR SEWING BUTTONHOLE

CROSS-REFERENCE TO RELATED APPLICATION

This application claims priority to Japanese Patent Application No. 2008-153753,filed Jun. 12, 2008,the disclosure of which is hereby incorporated herein by reference in its entirety.

BACKGROUND

The present invention relates to a sewing machine and a computer-readable medium storing a program for sewing a buttonhole. More specifically, the present disclosure relates to a sewing machine that is capable of sewing a buttonhole and a computer-readable medium storing a program for sewing a buttonhole that is executable on a sewing machine.

Conventionally, when sewing a buttonhole with a sewing machine, a buttonhole-sewing holding member such as those disclosed in Japanese Laid Open Patent Publication Nos. Sho 59-57689 and Sho 59-62083 have been used. The buttonhole-sewing holding member includes a presser foot to be attached to a presser bar and a presser frame mounted to the presser foot. The presser frame is mounted to the presser foot in such a manner that the presser frame can relatively move in a direction in which work cloth is fed. More specifically, the presser foot is fixed to the presser bar, while the presser frame moves together with the work cloth as sewing goes on, and the presser frame slides with respect to the presser foot. Further, to a rear end of the presser frame, a positioning member is provided. A button may be placed on the positioning member. A dog provided to the positioning member may move in accordance with a diameter of the button. A head portion of the sewing machine has a switch that includes a lever that can be pulled down to the vicinity of the buttonhole-sewing holding member. The switch can detect a contact between the lever and the dog provided to the buttonhole-sewing holding member. With such a configuration, sewing of a buttonhole in its longitudinal direction (overcasting of one of its hems) may proceed until the dog contacts the lever, whereupon it is determined that the sewing for a necessary length has been completed. Subsequently, a bar tack is sewn, and sewing back in the longitudinal direction (overcasting of the other hem) may be performed. In such a manner, the length of the buttonhole may automatically be determined in accordance with the diameter of the button. The sewing machine that utilizes the buttonhole-sewing holding member does not use the lever of the switch in ordinary sewing other than buttonhole sewing. Accordingly, this type of sewing machine may employ such a mechanism as to store the lever in its head portion. Therefore, when sewing a buttonhole, a user of the sewing machine may need to lower the lever stored in the head portion of the sewing machine.

Further, in an automatic buttonholer of a sewing machine disclosed in Japanese Laid Open Patent Publication No. Sho 54-76348,an arm portion of the sewing machine is equipped with a mechanism to detect a size of a button. A hole is formed in the arm portion and has a slide volume control fitted in the hole. By placing a button in this hole and sandwiching the button between a slider of the slide volume control and a side wall of the hole, a voltage is output that has a magnitude in accordance with a diameter of the button. Furthermore, another slide volume control is provided to a buttonhole-sewing holding member, and a voltage is output that has a magnitude in accordance with a distance by which the slide volume control has moved (by which a work cloth has moved). Then, the buttonhole may be sewn in accordance with the diameter of the button and the amount of movement of the work cloth. Further, in an automatic buttonhole forming apparatus of a sewing machine disclosed in Japanese Laid Open Utility Model Publication No. Sho 54-119760,a thickness and a diameter of a button are measured electrically with a slide volume control.

SUMMARY

In the case of the sewing machines disclosed in Japanese Laid Open Patent Publication Nos. Sho 59-57689 and Sho 59-62083,the user needs to lower the lever when sewing a buttonhole, which is a troublesome job. The automatic buttonholer and the automatic buttonhole forming apparatus disclosed in Japanese Laid Open Patent Publication No. Sho 54-76348 and Japanese Laid Open Utility Model Publication No. Sho 54-119760, the mechanism to measure a button size is required only for use in sewing of a buttonhole, thus increasing costs. In addition, the mechanism requires a certain amount of space. Further, the user needs to go through the trouble of measuring a button size.

Various exemplary embodiments of the general principles described herein provide a sewing machine that is capable of sewing a buttonhole that fits a size of a button without causing a trouble for a user, and a computer-readable medium storing a program for sewing such a buttonhole with a sewing machine.

The exemplary embodiments provide a sewing machine that includes an image capturing device that captures an image, and a sewing device that sews a buttonhole having a length in accordance with a shape of a button, based on an image of the button captured by the image capturing device.

The exemplary embodiments also provide a sewing machine that includes an image capturing device that captures an image, and a sewing device that includes a needle bar to which a sewing needle is attached and a mechanism that causes a movement of a sewing target relative to the needle bar. The sewing device sews a buttonhole having a length in accordance with a shape of a button, based on images of the sewing target or a moving member that moves with the sewing target. The images are captured by the image capturing device and include the sewing target or the moving member at different positions.

The exemplary embodiments further provide a computer-readable medium storing a computer-executable program for sewing a buttonhole with a sewing machine, which includes an image capturing device and a sewing device. The computer-executable program includes instructions for capturing an image of a button with the image capturing device, and sewing a buttonhole having a length in accordance with a shape of the button with the sewing device, based on the captured image of the button.

The exemplary embodiments further provide a computer-readable medium storing a computer-executable program for sewing a buttonhole with a sewing machine, which includes an image capturing device and a sewing device. The computer-executable program includes instructions for capturing images of a sewing target or a moving member at different positions, and sewing a buttonhole having a length in accordance with a shape of a button, based on the captured images of the sewing target or the moving member.

BRIEF DESCRIPTION OF THE DRAWINGS

Exemplary embodiments of the present disclosure will be described below in detail with reference to the accompanying drawings in which:

FIG. 7 is an explanatory diagram showing an example of buttonhole sewing data stored in a data table;

FIG. 8 is another explanatory diagram showing the example of the buttonhole sewing data stored continuously in the data table shown in FIG. 7;

FIG. 12 is an explanatory diagram showing states of an first pointer P1 and a second pointer P2 at the time of sewing a buttonhole based on the buttonhole sewing data;

FIG. 13 is another explanatory diagram continued from FIG. 12, showing the states of the first pointer P1 and the second pointer P2 at the time of sewing the buttonhole based on the buttonhole sewing data; and FIG. 14 is a further explanatory diagram continued from FIG. 13, showing the states of the first pointer P1 and the second pointer P2 at the time of sewing the buttonhole based on the buttonhole sewing data.

DETAILED DESCRIPTION OF EMBODIMENTS

Figure 1:
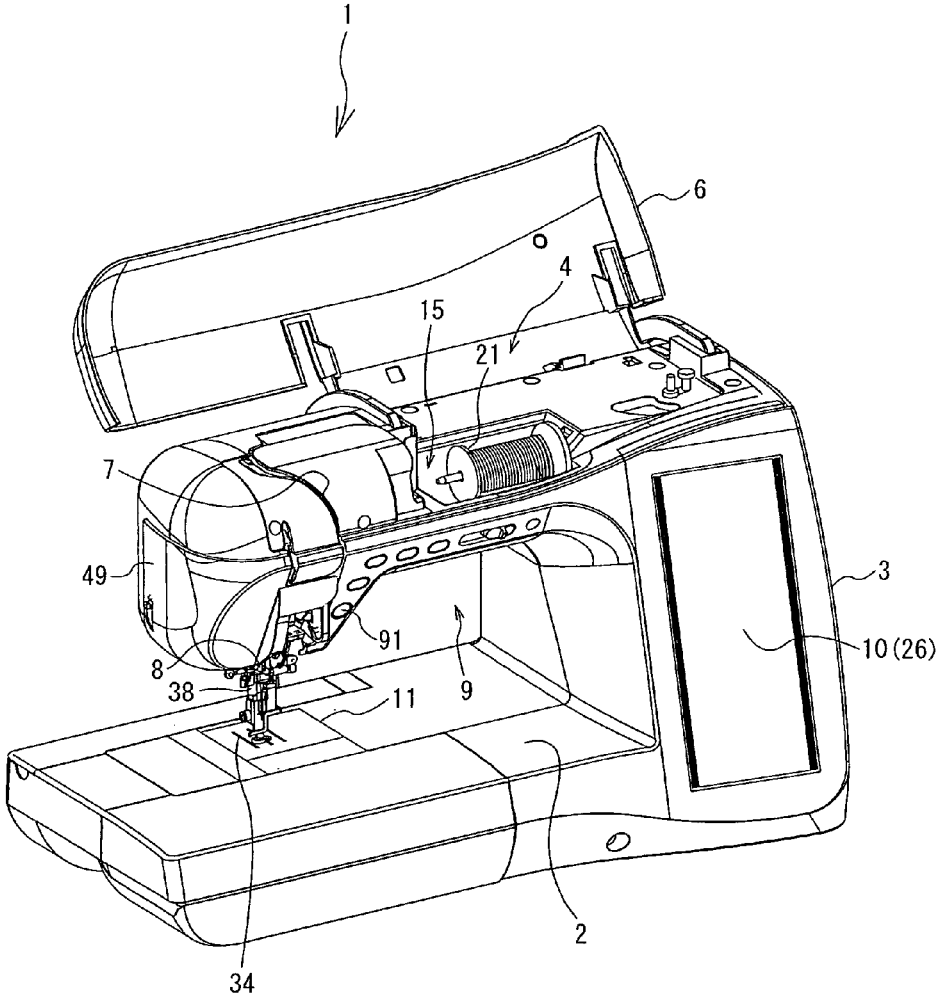
FIG. 1 is a perspective view of a sewing machine.

A description will be given of a physical configuration of a sewing machine 1 according to an exemplary embodiment with reference to FIGS. 1 and 2. As shown in FIG. 1, the sewing machine 1 includes a bed portion 2, a pillar 3 that is erected perpendicularly from the bed portion 2 at the right end of the bed portion 2, an arm portion 4 that extends leftward from the upper end of the pillar 3, face-to-face to the bed portion 2, and a head portion 49, which is an end portion of the arm portion 4. The side of the sewing machine 1 that faces a user (sewing machine operator) of the sewing machine 1 is referred to as a "front side" and the opposite side is referred to as a "rear side". Further, the side at which the pillar 3 is positioned is referred to as a "right side" and the opposite side is referred to as a "left side".

The bed portion 2 includes a needle plate 1. The needle plate 1 1 has a square hole 34 formed therein, through which a feed dog (not shown) raised and lowered. In the bed portion 2 below the needle plate 1, a shuttle mechanism (not shown) is mounted to store a bobbin for a bobbin thread (not shown). Further, below the needle plate 1, the feed dog that feeds a work cloth, which is a sewing target, by a predetermined feed distance, and a feed mechanism (not shown) that drives the feed dog are also provided. The feed mechanism employed here may be a known mechanism such as described in Japanese Laid Open Patent Publication No. 2006-346087,for example.

In a lower part of the pillar 3, a sewing machine motor 79 (see FIG. 3) is mounted. A driving force from the sewing machine motor 79 is transmitted via a drive belt (not shown) to a drive shaft 51 (see FIG. 3) that extends in the arm portion 4 in the right-and-left direction. The driving force from the sewing machine motor 79 is also transmitted via a transmission mechanism (not shown) provided at a position along the drive shaft 51 to a lower shaft (not shown) that extends in the bed portion 2 in the right-and-left direction. With such a configuration, a needle bar 8, a thread take-up mechanism (not shown), the shuttle mechanism (not shown), and the feed mechanism (not shown), etc. may be driven synchronously. The feed mechanism includes a feed regulator (not shown) that regulates a feed distance by which the work cloth is fed by the feed dog and a feed adjustment motor 201 (see FIG. 5) that drives the feed regulator.

As shown in FIG. 1, the pillar 3 includes a vertically long liquid crystal display (hereinafter referred to as "LCD") 10. Function names of various functions required for various sewing jobs, such as selecting and editing of a sewing pattern, and various messages etc. may be displayed on the LCD 10. The LCD 10 has a touch panel 26 (see FIG. 5) on its front surface. When the user selects any item displayed on the LCD 10 with a finger or a dedicated pen, the selected item may be detected by the touch panel 26. Thus, various instructions can be entered through the LCD 10 and the touch panel 26.

In an upper part of the arm portion 4, a concaved spool housing 15 is provided. The spool housing 15 stores a thread spool 21 around which a needle thread is wound. Further, at a lower part of the head portion 49, the needle bar 8 is disposed. A sewing needle 16 (see FIG. 2) is attached to the needle bar 8. In the head portion 49, a needle bar vertical movement mechanism 55 (see FIG. 3) that drives the needle bar 8 with the sewing needle 16 in the vertical direction, a needle bar swinging mechanism 59 (see FIG. 3) that swings the needle bar 8 in the right and left directions, and the thread take-up mechanism (not shown) are mounted.

The arm portion 4 has a thread guide groove 7 formed therein. The thread guide groove 7 guides the needle thread pulled out from the thread spool 21 via a thread tension mechanism, a thread take-up spring, and a thread take-up lever, etc., none of which is shown, to the sewing needle 16. Still further, the arm portion 4 has a plurality of operation keys 9 that are used to enter instructions to carry out various sewing operations on its front surface. The operation keys 9 include, for example, a sewing start-and-stop switch 91 for instructing a start or a stop of sewing.

Figure 2:
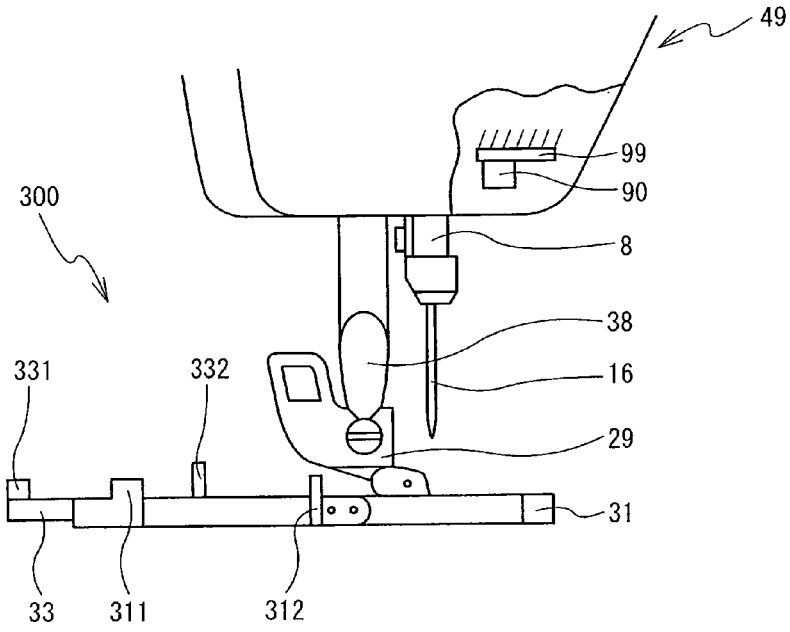
FIG. 2 is a left side view of main components of a head portion.

As shown in FIG. 2, at the rear side of the needle bar 8, a presser bar 38 is mounted. A presser foot holder 29 is attached to a lower end portion of the presser bar 38. A detachable buttonhole foot 300 is attached to the presser foot holder 29. The buttonhole foot 300 will be described in detail later. On the front side of the needle bar 8 and somewhat to the right of the needle bar 8 in front view in the head portion 49, an image sensor 90 is mounted in such a manner that the image sensor 90 can capture an image of an entirety of the needle plate 11. The image sensor 90 is equipped with a CMOS sensor and a control circuit, and captures an image with the CMOS sensor. In the present embodiment, as shown in FIG. 2, a support frame 99 is fixed to a frame (not shown) of the sewing machine 1, and the image sensor 90 is fixed to the support frame 99.

Figure 3:
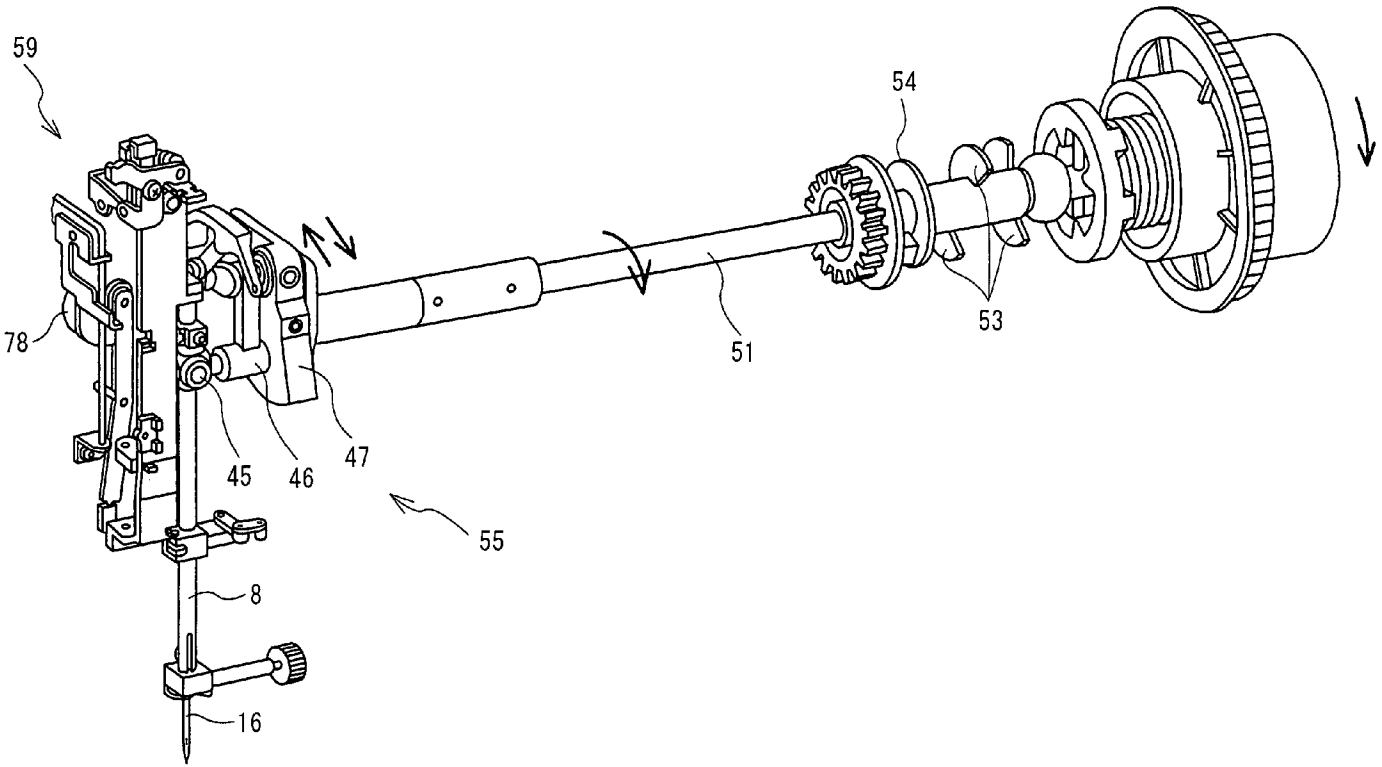
FIG. 3 is a perspective view of a needle bar and a needle bar vertical movement mechanism of the sewing machine.

Next, a description will be given of the needle bar vertical movement mechanism 55 and the needle bar swinging mechanism 59 with reference to FIG. 3. As shown in FIG. 3, the needle bar vertical movement mechanism 55 includes the drive shaft 51, a thread take-up crank 47, a needle bar crank rod 46, and a needle bar bracket 45. The left end portion of the rod-shaped drive shaft 51 extending in the right-and-left direction is fixed to the right side surface of the thread take-up crank 47, and the upper end portion of the needle bar crank rod 46 is rotatably coupled to the left side surface of the thread take-up crank 47. To the lower end of the needle bar crank rod 46, the needle bar bracket 45 is coupled. The needle bar bracket 45 is slidably supported by the needle bar 8. The needle bar 8 can be moved up and down by the needle bar vertical movement mechanism 55 as follows. When the drive shaft 51 rotates as the drive shaft 51 is driven by the sewing machine motor 79, rotary movement of the drive shaft 51 is transmitted via the thread take-up crank 47 and the needle bar crank rod 46 to the needle bar bracket 45 as a vertical movement. The vertical movement of the needle bar bracket 45 is transmitted to the needle bar 8 so that the needle bar 8 may be moved up and down.

A rotary shutter 53 including a plurality of fan-shaped shield plates and an encoder disk 54 having a plurality of minute slits formed therein is mounted to the drive shaft 51. In addition, a drive shaft angle sensor 32 (see FIG. 5) that optically detects a rotation of the rotary shutter 53 and the encoder disk 54 is mounted to the frame of the sewing machine 1. A rotation angle of the drive shaft 51 detected by the drive shaft angle sensor 32 is used to determine the vertical position of the needle bar 8. Each time the drive shaft 51 rotates once (by 360 degrees), one stitch is formed (one stitch is sewn). Therefore, by successively detecting the rotation angle with the drive shaft angle sensor 32, it is possible to detect that a stitch has been formed.

The needle bar swinging mechanism 59 shown in FIG. 3 is a known mechanism, details of which are not shown. The needle bar swinging mechanism 59 moves the needle bar 8 in the right-and-left direction by driving an eccentric swing cam (not shown) that can be rotated by a needle bar swinging motor 78 as a power source.

Figure 4:
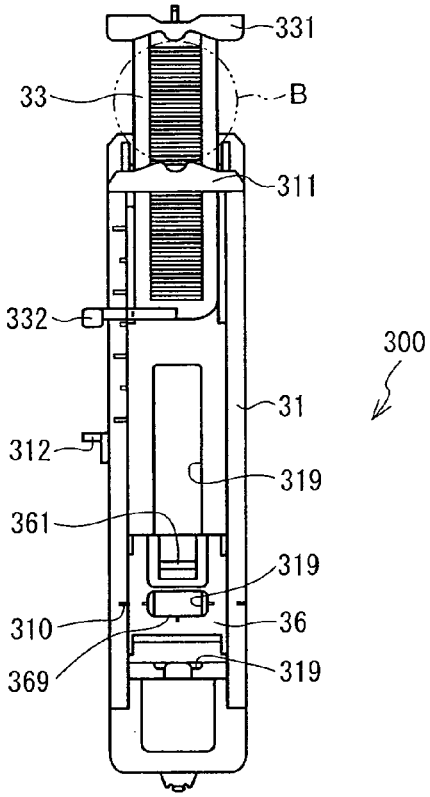
FIG. 4 is a plan view of a buttonhole foot.

Next, the buttonhole foot 300 will be described with reference to FIGS. 2 and 4. The bottom side of FIG. 4 is referred to as a front side of the buttonhole foot 300, and the top side of FIG. 4 is referred to as a rear side of the buttonhole foot 300. The buttonhole foot 300 is similar to a known holding member for buttonhole sewing, and includes a holding portion 31, a support portion 36, and a button guide plate 33. The holding portion 31 that holds the work cloth has an elongated and roughly rectangular shape as viewed in ground plan. The holding portion 31 has an opening 319 at a position a little forward from the center of the holding portion 31. The sewing needle 16 passes through the opening 319. Further, the holding portion 31 is fitted with the support portion 36 in such a manner that the support portion 36 can slide in the front-and-rear direction. The support portion 36 has a needle drop hole 369 formed at the center. The opening 319 extends forward to the needle drop hole 369 so that the sewing needle 16 may pass through the needle drop hole 369 and the opening 319 when sewing. Further, although not shown, on the back surface (bottom surface) of the holding portion 31, a rubber-made anti-slip sheet is stuck, which prevents the work cloth from slipping.

Further, although not shown, in the front end portion of the holding portion 31, a flat spiral spring is stored. An end portion of the flat spiral spring is fixed to the front end portion of the support portion 36. Therefore, the support portion 36 is always held at the front end in a slidable range, owing to the spring force of the flat spiral spring. The position of the support portion 36 shown in FIG. 4 provides an initial position for sewing a buttonhole. Note that the spring force of the flat spiral spring is set to such a low level as not to affect the buttonhole sewing. When the presser foot holder 29 attached to the presser bar 38 is detachably engaged with a fitting pin 361 mounted to the support portion 36, the buttonhole foot 300 is attached to the presser foot holder 29.

Further, to the rear end of the holding portion 31, a button guide plate 33 is fitted. A button B may be placed on the button guide plate 33 as shown in a dashed-two-dotted line. Although not shown in detail, the button guide plate 33 is supported in such a manner that the button guide plate 33 can move in the front-and-rear direction with respect to the holding portion 31. To the rear end of the button guide plate 33, an abutment portion 331 is provided, and to the left front end of the button guide plate 33, a protrusion 332 is provided. Moreover, the holding portion 31 has a protrusion 312 on its left side surface. Further, the holding portion 31 is fitted with an abutment portion 311 in such a manner that the button guide plate 33 may be sandwiched between the abutment portion 311 and the holding portion 31.

When a user wishes to sew a buttonhole that fits a size of a button with a conventional home sewing machine, the user first places the button B on the button guide plate 33. The user then moves the button guide plate 33 forward on which the button B is placed such that the button is sandwiched between the abutment portions 331 and 311. This causes a distance between the protrusions 312 and 332 to be set in accordance with the button size. By detecting the distance between the protrusions 312 and 332 by using the detection lever mounted in the sewing machine head portion, the buttonhole can be sewn in accordance with the button size. More specifically, when the work cloth is fed forward or backward by the feed dog as the buttonhole is sewn, the anti-slip sheet stuck to the back surface of the holding portion 31 causes the holding portion 31 to move integrally with the work cloth. When the detection lever abuts against the protrusion 312 or 332, sewing of the buttonhole that fits the button size may be completed.

Unlike the conventional sewing machine, however, according to the sewing machine 1 of the present embodiment, an image of a button may be captured by the image sensor 90 and, based on the captured image, a buttonhole may be sewn. Accordingly, the user may not need to place the button on the buttonhole foot 300 and the detection lever may be rendered unnecessary. Therefore, in the present embodiment, when sewing a buttonhole, in place of the buttonhole foot 300, a typical presser foot for a utility stitch, such as a straight stitch and a zigzag stitch, may be used. Nevertheless, in order to sew a buttonhole neatly by a small stitch length without any trouble such as puckering, the buttonhole foot 300 may preferably be used to give a moderate tension to a portion of the work cloth where the buttonhole is to be sewn. When sewing a buttonhole with an embroidery sewing machine that performs sewing while a work cloth held by an embroidery frame is moved with respect to a needle bar, such as disclosed in Japanese Laid Open Patent Publication No. 2007-252616,the embroidery frame may be employed, in place of the buttonhole foot 300. Further, a buttonhole foot that has only the holding portion 31 and the support portion 36 wherein the sewing needle 16 can be inserted through the needle drop hole 369 and the opening 319 may be employed. In other words, the buttonhole foot that does not have the button guide plate 33 or the protrusions 312 and 332 may be employed.

Figure 5:
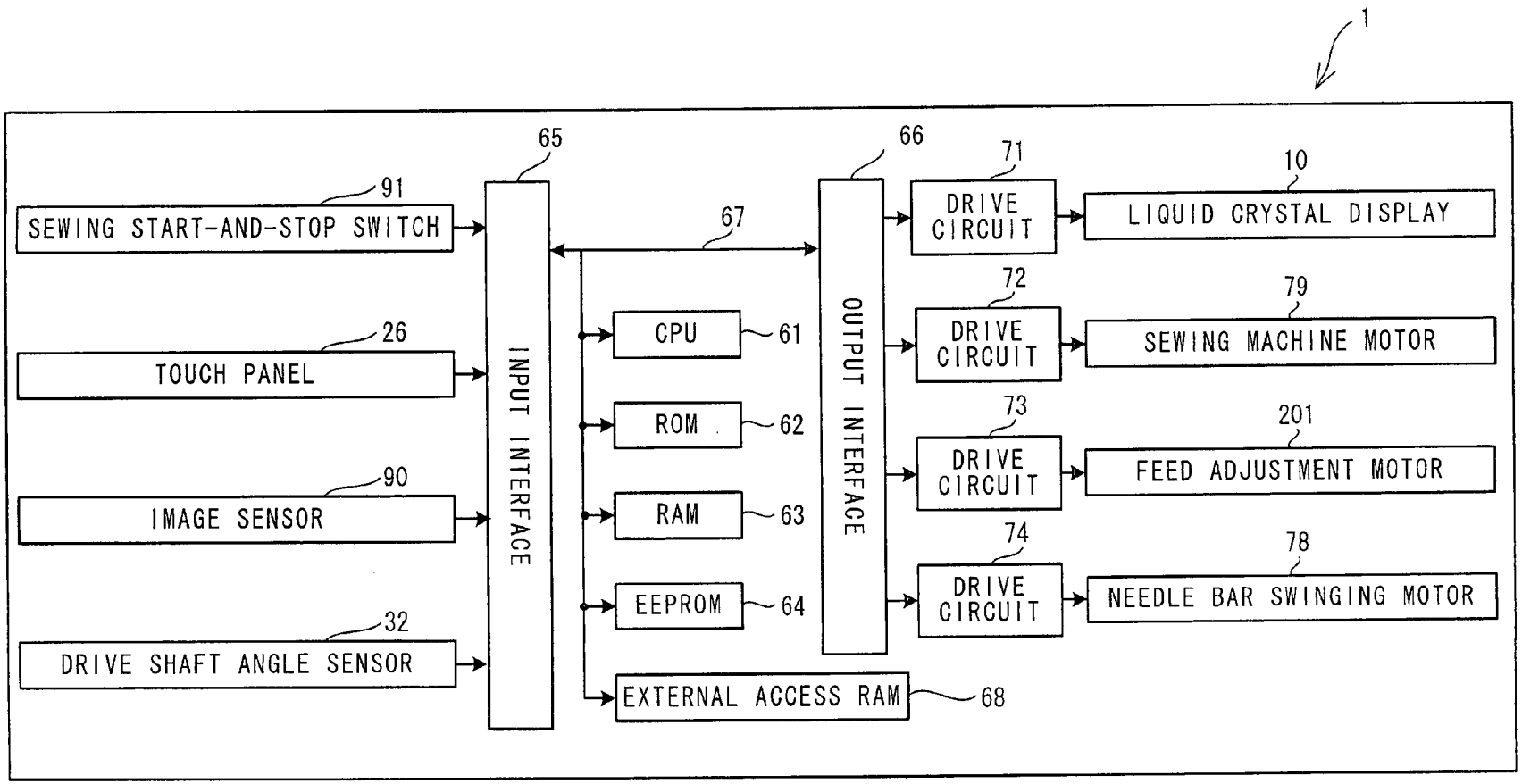
FIG. 5 is a block diagram showing an electrical configuration of the sewing machine.

Next, an electrical configuration of the sewing machine 1 will be described with reference to FIG. 5. As shown in FIG. 5, the sewing machine 1 includes a CPU 61, a ROM 62, a RAM 63, an EEPROM 64, an external access RAM 68, an input interface 65, an output interface 66, which are connected to each other via a bus 67. The sewing start-and-stop switch 91, the touch panel 26, the image sensor 90, and the drive shaft angle sensor 32 are connected to the input interface 65. Drive circuits 71, 72, 73, and 74, which respectively drive the LCD 10, the sewing machine motor 79, the feed adjustment motor 201, and the needle bar swinging motor 78, are connected to the output interface 66.

The CPU 61 controls the sewing machine 1 and performs various computations and processing in accordance with a control program stored in a control program storage area of the ROM 62, which is a read-only memory. The RAM 63, which is a random access memory, has various storage areas arranged therein as necessary to store the results of computations performed by the CPU 61. In the ROM 62, in addition to a control program for sewing buttonholes, other control programs for sewing other patterns are stored as in the case of a conventional sewing machine. Examples of the other patterns include embroidery patterns and utility stitches, such as a straight stitch and a zigzag stitch. Further, a display control program is stored in the ROM 62. The display control program enables display of an image of the needle plate 11 captured by the image sensor 90 while sewing at least one pattern among various patterns including the buttonholes, the embroidery patterns, and the utility stitches.

Figure 6:
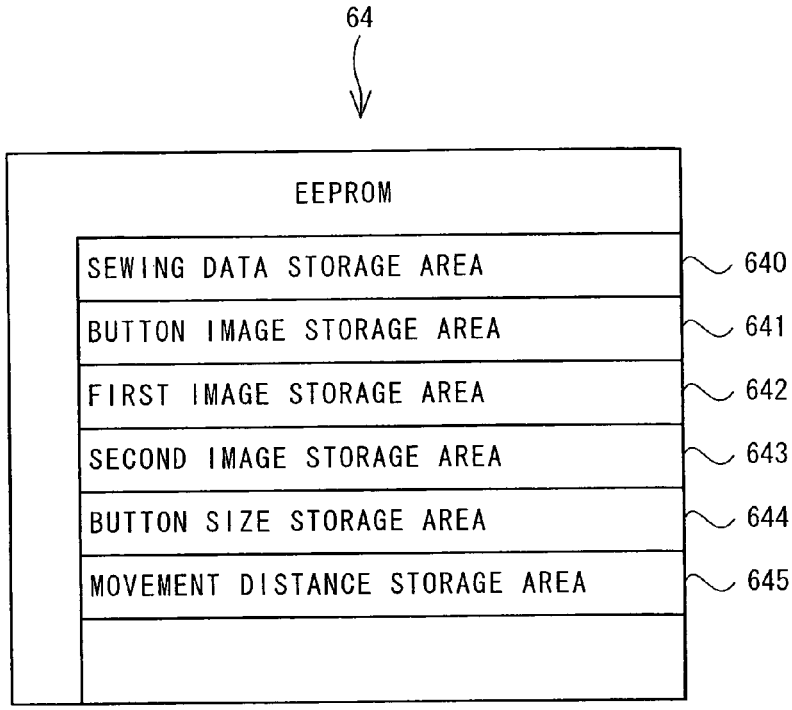
FIG. 6 is a conceptual diagram showing storage areas arranged in an EEPROM.

Next, the storage areas arranged in the EEPROM 64 will be described with reference to FIG. 6. As shown in FIG. 6, the EEPROM 64 has a sewing data storage area 640, a button image storage area 641, a first image storage area 642, a second image storage area 643, a button size storage area 644, and movement amount storage area 645. Besides these areas, the EEPROM 64 may include other storage areas (not shown).

The sewing data storage area 640 stores sewing data to be used in sewing embroidery patterns, decorative stitches, utility stitches, and the like. The sewing data stored in the sewing data storage area 640 includes sewing data (hereinafter referred to as "buttonhole sewing data") to be used for sewing a buttonhole. The button image storage area 641 stores an image (hereinafter referred to as "button image") that has been captured for calculating a diameter of a button (hereinafter referred to as a "button size"). The button size calculated from the button image is stored in the button size storage area 644. During sewing a buttonhole, sewing is performed while a work cloth is moved in a longitudinal direction of the buttonhole (F-axial direction in FIG. 9). Sewing that is performed while a work cloth is moved in a longitudinal direction of the buttonhole is hereinafter referred to as "sewing in the longitudinal direction". An image (hereinafter referred to as "first image") is captured before sewing in the longitudinal direction is started, and stored in the first image storage area 642. An image (hereinafter referred to as "second image") is captured as one stitch is formed during the sewing in the longitudinal direction, and stored in the second image storage area 643. The movement amount storage area 645 stores an amount of movement (movement amount) of the work cloth calculated on the basis of comparison between the first and second images.

Next, a description will be given of the buttonhole sewing data with reference to FIGS. 7 and 8. As shown in FIGS. 7 and 8, buttonhole sewing data includes rows of data, each row including data items of a "feed pitch", a "needle bar swinging pitch", and a "loop flag". Each row of data is read and processed at a time. For convenience of explanation, in data tables shown in FIGS. 7 and 8, a data number is assigned to each row of data. For the data item "feed pitch", a feed distance, by which the work cloth is to be fed forward or backward from a current position, is stored. For the data item "needle bar swinging pitch", a swing distance, by which the sewing needle 16 is to be swung in the right-and-left direction, is stored. In the present embodiment, one pitch is set to 0.01 mm. Further, for the data item "loop flag", a loop flag that indicates how to process the data is stored. The loop flag may take on a value of "0", "1", or "2". The value "0" indicates that the row of data is to be used only once. The values "1" and "2" are used in a case where the row of data is to be used repeatedly. More specifically, the rows of data from the row including loop flag "1" to the row including loop flag "2" are to be processed repeatedly. In other words, after the row of data including loop flag "2" is processed, the row of data including loop flag "1" is processed again. Such rows of data to be processed repeatedly are hereinafter referred to as "repetitive data rows". Such repeated processing is applied to a portion of a buttonhole stitch pattern where sewing in the longitudinal direction is performed. The repetition ends when sewing in the longitudinal direction has been completed to reach a button size. Thus, a buttonhole corresponding to any button size can be sewn without the need to prepare sets of sewing data in accordance with various button sizes.

Figure 9:
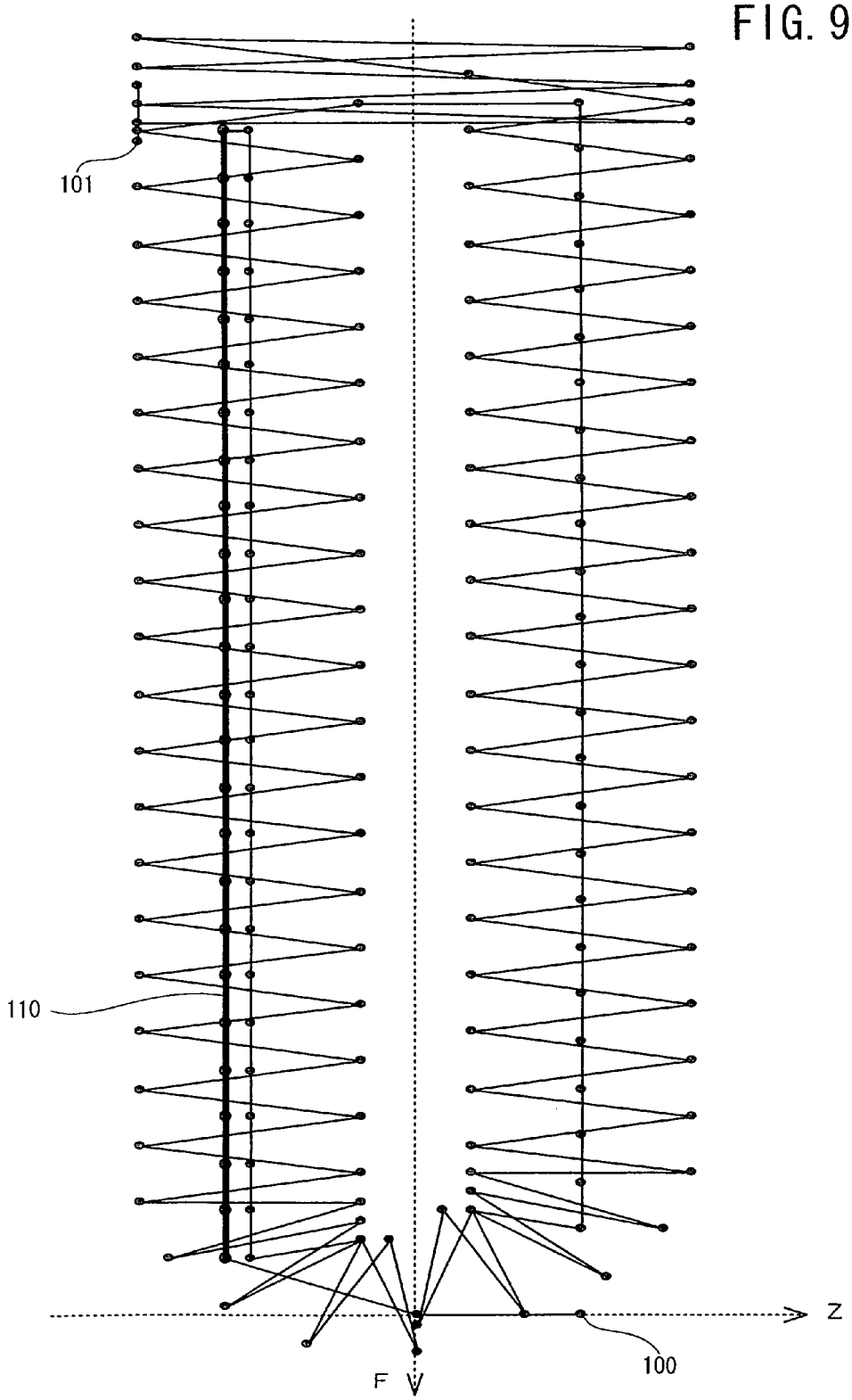
FIG. 9 is a schematic diagram showing a sewing of a buttonhole.

If a buttonhole is sewn by processing the buttonhole sewing data shown in FIGS. 7 and 8, a buttonhole stitch such as shown in FIG. 9 is formed. In FIG. 9, round dots indicate needle drop points, and each line segment that connects two needle drop points indicates a stitch. A needle drop point 100 is a first needle drop point and a needle drop point 101 is the last needle drop point for sewing the buttonhole. In FIG. 9, a straight line that is parallel to the longitudinal direction of the buttonhole and passes through the center of a width of the buttonhole is defined as an F-axis. Further, a Z-axis is defined by setting an F coordinate of the first needle drop point 100 for sewing the buttonhole as zero (0). The F and Z axes define a coordinate system for the work cloth. In the example of FIG. 9, an origin corresponds to a center baseline position of the sewing needle 16 at the start of sewing the buttonhole. It should be noted that in FIG. 9, different scales are used for the F-axis and the Z-axis. Further, although some line segments (a group of stitches 110) that indicate a part of the stitches are drawn thicker for an explanation purpose, these stitches 110 have the same shape as others.

Figure 10:
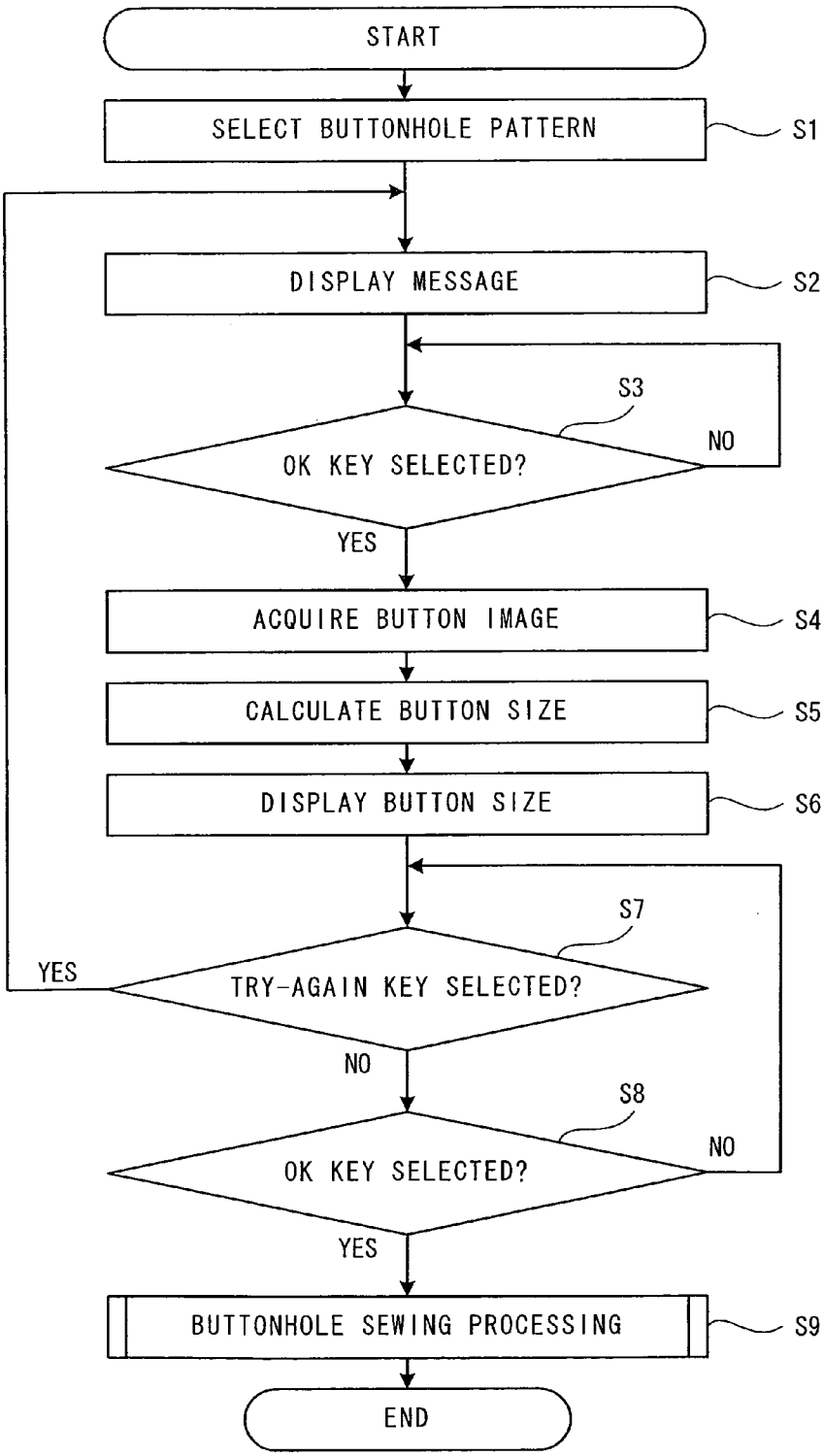
FIG. 10 is a flowchart of main processing.
Figure 11:
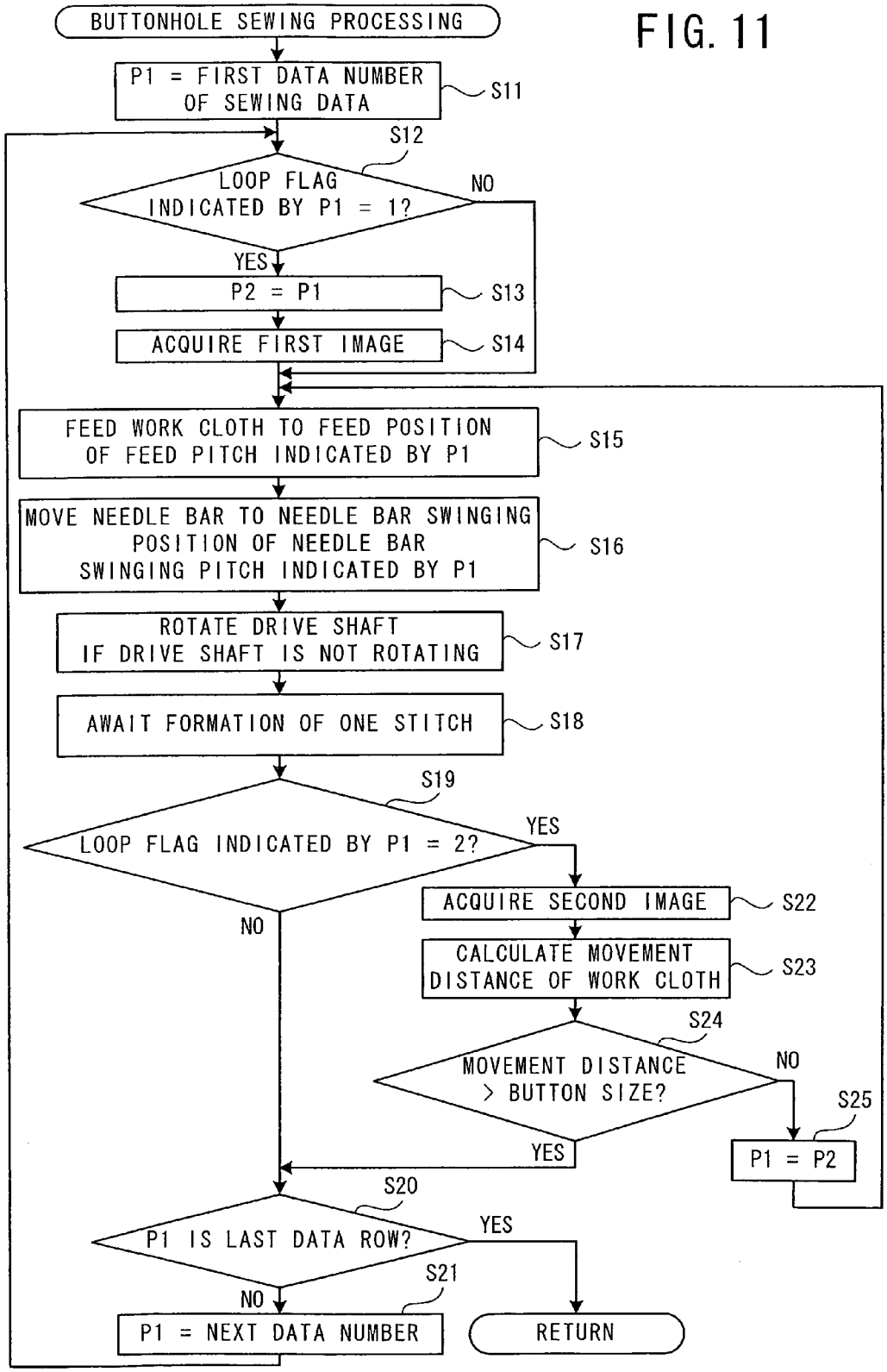
FIG. 11 is a flowchart of buttonhole sewing processing that is performed in the main processing.

Next, a description will be given of processing of a buttonhole sewing program to be executed by the CPU 61 in the sewing machine 1, with reference to flowcharts of FIGS. 10 and 11. The buttonhole sewing program is stored in the ROM 62 and is executed if the user selects a buttonhole sewing menu by manipulating the touch panel 26.

First, a screen (not shown) for selecting a buttonhole stitch appears on the LCD 10, to accept an entry by the user (S1). There are various buttonhole stitches, including a straight buttonhole with one round end shown in FIG. 9. Other patterns include, for example, a straight buttonhole with round ends, a straight buttonhole with straight bar tacks on both ends, a keyhole buttonhole with an eyelet on one end. The selection screen that appears on the LCD 10 selectively displays the shapes (buttonhole stitch patterns) of buttonhole stitches that can be sewn by the sewing machine 1. Then, the sewing data of a buttonhole stitch selected by the user is read from the sewing data storage area 640.

Subsequently, an OK key and a message that instructs image capturing of a button are displayed on the LCD 10 (S2). For example, the message may say "Button will be photographed. Put the button on the needle plate and press the OK key". If the OK key is selected on the touch panel 26 (YES at S3), an image of the button is captured by the image sensor 90 and stored as the button image in the button image storage area 641 (S4). Then, a region of the button is extracted from the button image by using known image processing technology, a diameter of the button is calculated, and the calculated diameter is stored as the button size in the button size storage area 644 (S5). In extracting the region of the button, for example, a region having a color different from the needle plate 11 may be extracted as the region of the button. Alternatively, by comparing the button image to an image of the needle plate 11 captured beforehand, a region that is different from the corresponding region in the image of the needle plate 11 may be extracted as the button region. Then, the button size may be calculated by converting the number of pixels in the extracted button region into a length.

Next, the calculated button size, an OK key, and a try-again key are displayed on the LCD 10 (S6). By thus notifying the user of the calculated button size, the user can be aware of the diameter of the button. Besides the button size, the button image may be displayed. If the try-again key is selected (YES at S7), the processing returns to step S2, where a message appears to instruct image capturing of the button to acquire a button image (S2). If the OK key is selected, instead of the try-again key (NO at S7 and YES at S8), buttonhole sewing processing is carried out (S9 and FIG. 11). In other words, if the user determines that the calculated button size is appropriate, the user may press the OK key to start buttonhole sewing. On the other hand, if the user determines that the button size is not appropriate (for example, if the button image does not cover the entire button), the user may as well select the try-again key to calculate the button size again.

Next, the buttonhole sewing processing will be described with reference to FIG. 11. In the following description, the buttonhole sewing data shown in FIGS. 7 and 8 is used as an example. In the buttonhole sewing processing, a first pointer P1 and a second pointer P2 are used. These pointers are stored in predetermined storage areas of the RAM 63. FIGS. 12 to 14 show needle drop points for a buttonhole stitch as coordinates on a work cloth (in an FZ coordinate system of FIG. 9), in a case where the buttonhole stitch is to be formed based on the buttonhole sewing data shown in FIGS. 7 and 8. For each of the first and second pointers P1 and P2, a data number of the buttonhole sewing data is stored. The last row of data in the data table of FIG. 12 is followed by the first row of data in the data table of FIG. 13. Similarly, the last row of data in the data table of FIG. 13 is in turn followed by the first row of data in the data table of FIG. 14.

First, for the first pointer P1, the first data number of the buttonhole sewing data is stored (S11). In this example, the first pointer P1 is set to one (P1=1). Then, a determination is made as to whether the loop flag of the row of data that is indicated by the first pointer P1 is 1 (S12). If the loop flag is 1,the row of data is a start data row of the repetitive data rows. As shown in FIG. 7, because the loop flag of the data row with data number 1 is zero (0) (NO at S12), the processing proceeds to step S15. Then, the feed adjustment motor 201 is driven by the drive circuit 73 so that the feed dog may feed the work cloth to a feed position specified by the feed pitch included in the data row indicated by the first pointer P1 (S 15). As shown in FIG. 7, because the feed pitch included in the row of data having data number 1 is 0,the feed adjustment motor 201 adjusts the feed regulator (not shown) so that the feed distance may be 0. Subsequently, the needle bar swinging motor 78 is driven by the drive circuit 74 so that the sewing needle 16 may be moved to a needle bar swinging position specified by the needle bar swinging pitch included in the data row indicated by the first pointer P1 (S116). As shown in FIG. 7, because the needle bar swinging pitch included in the row of data having data number 1 is 150,the sewing needle 16 is moved to a position of pitch 150 in the positive direction along the F-axis. This position corresponds to the coordinates (F, Z)=(0, 150) of the first needle drop point 100 in the FZ coordinate system on the work cloth.

Subsequently, if the drive shaft 51 is not being rotated, rotation of the drive shaft 51 is started (S17). Then, the formation of one stitch is awaited (S18). A rotation of the drive shaft 51 is detected by the drive shaft angle sensor 32. If the drive shaft 51 makes a 360-degree rotation to form one stitch, a determination is made as to whether the loop flag of the row of data indicated by the first pointer P1 is 2 (S19). If the loop flag is 2 (YES at S19), a determination needs to be made as to whether the repeated processing may be ended. Consequently, processing of steps S22 to S24 is carried out. In the first round of the processing, however, the first pointer P1 is 1 (P1=1) and, as shown in FIG. 7, the loop flag of the row of data having data number 1 is 0 (NO at S19). Accordingly, the processing proceeds to step S20.

Then, a determination is made as to whether the data row indicated by the first pointer P1 is the last data row of the buttonhole sewing data (S20). In a case when the first pointer P1 is 1 (P1=1), the data row is not the last data row (NO at S20). In such a case, data number 2 corresponding to the next data row is stored as the first pointer P1 to process the next data (S21). Then, the processing returns to step S112.

The first pointer P1 is 2 (P1=2) and as shown in FIG. 7, the loop flag is 0 for the row of data having data number 2 indicated by the first pointer P1. In other words, the loop flag is not 1 (NO at S12). Then, the work cloth is fed to a feed position specified by the feed pitch included in the data row indicated by the first pointer P1 (S15), and the sewing needle 16 is moved to a swinging position specified by the needle bar swinging pitch included in the data row indicated by the first pointer P1 (S16). As shown in FIG. 7, the feed pitch and the needle bar swinging pitch included in the data row having data number 2 are both 0, which means that the feed distance is 0, and the needle bar swinging distance is 0 (that is, the sewing needle 16 is positioned at the center baseline position). These values determine the coordinates of a needle drop point in the FZ coordinate system on the work cloth as (0, 0). The drive shaft 51 has been started to rotate (S117), so that the formation of one stitch is awaited (S18). The loop flag of the data row having data number 2 is not 2 (NO at S19), and the data row is not the last data row (NO at S20). Therefore, after the first pointer P1 is set to 3 (P1=3) (S21), the processing returns to step S12.

The first pointer P1 is 3 (P1=3) and as shown in FIG. 7, the loop flag is 0 for the row of data having data number 3 indicated by the first pointer P1. In other words, the loop flag is not 1 (NO at S12). Then, the work cloth is fed to a feed position specified by the feed pitch included in the data row indicated by the first pointer P1 (S15), and the sewing needle 16 is moved to a swinging position specified by the needle bar swinging pitch included in the data row indicated by the first pointer P1 (S116). As shown in FIG. 7, the feed pitch is −108 and the needle bar swinging pitch is −175 for the data row having data number 3, which means that the work cloth is fed by as much as −108. Because the previous F coordinate of the needle drop point is 0, the current F coordinate is determined as 108. Therefore, the coordinates of a needle drop point in the FZ coordinate system on the work cloth are determined as (108, −175). The drive shaft 51 is rotating (S17), so that the formation of one stitch is awaited (S18). The loop flag of the data row having data number 3 is not 2 (NO at S19), and the data row is not the last data row (NO at S20). Therefore, after the first pointer P1 is set to 4 (P1=4) (S21), the processing returns to step S12.

The first pointer P1 is 4 (P1=4) and as shown in FIG. 7, the loop flag is 1 for the row of data having data number 4 indicated by the first pointer P1 (YES at S112). In other words, the data row having data number 4 is the first data row to be processed in the repeated processing. Therefore, a value of the first pointer P1 is stored as the second pointer P2 (S113). More specifically, the data number of the first data row of the repetitive data rows is stored as the second pointer P2. Subsequently, an image is captured by the image sensor 90 and stored as the first image in the first image storage area 642 (S114). More specifically, an image of the work cloth is captured prior to the start of sewing based on the repetitive data rows in the longitudinal direction of the buttonhole.

Subsequently, the work cloth is fed to a feed position specified by the feed pitch included in the data row indicated by the first pointer P1 (S15), and the sewing needle 16 is moved to a swinging position specified by the needle bar swinging pitch included in the data row indicated by the first pointer P1 (S16). As shown in FIG. 7, the feed pitch is −90 and the needle bar swinging pitch is −175 for the data row having data number 4, which means that the work cloth is fed by as much as −90. Because the previous F coordinate of the needle drop point is 108,the current F coordinate is determined as 198. Therefore, the coordinates of a needle drop point in the FZ coordinate system on the work cloth are determined as (198, −175). The values of the F coordinate in the FZ coordinate system on the work cloth are thus accumulated, as the work cloth is fed during sewing. The drive shaft 51 is rotating (S117), so that the formation of one stitch is awaited (S18). The loop flag of the data row having data number 4 is not 2 (NO at S19), and the data row is not the last data row (NO at S20). Therefore, after the first pointer P1 is set to 5 (P1=5) (S21), the processing returns to step S12.

The first pointer P1 is 5 (P1=5) and as shown in FIG. 7, the loop flag is 2 for the row of data having data number 5 indicated by the first pointer P1. In other words, the loop flag is not 1 (NO at S112). Then, the work cloth is fed to a feed position specified by the feed pitch included in the data row indicated by the first pointer P1 (S15), and the sewing needle 16 is moved to a swinging position specified by the needle bar swinging pitch included in the data row indicated by the first pointer P1 (S116). As shown in FIG. 7, the feed pitch is −90 and the needle bar swinging pitch is −175 for the data row having data number 5, which means that the work cloth is fed by as much as −90. Because the previous F coordinate of the needle drop point is 198, the current F coordinate is determined as 288. Therefore, the coordinates of a needle drop point in the FZ coordinate system on the work cloth are determined as (288, −175). The drive shaft 51 is rotating (S17), so that the formation of one stitch is awaited (S18). The loop flag of the data row having data number 5 is 2 (YES at S19). That is, the data row having data number 5 is the last data row in the repeated processing.

Consequently, an image of the work cloth is captured by the image sensor 90 and stored as the second image in the second image storage area 643 (S22). Then, the first image stored in the first image storage area 642 and the second image captured at step S22 are compared to each other. Based on the comparison result, a disagreement between the first and second images, that is, an amount of movement of the work cloth is obtained by a known method. The obtained value is stored as the movement amount in the movement amount storage area 645 (S23). In obtaining the disagreement between the first and second images, the known method called as block matching may be employed, for example. According to the block matching method, a difference (disagreement) between the two images can be detected as a vector. If the obtained vector has a length, it can be determined that the two images disagree with each other. Then, a determination is made as to whether the movement amount calculated at step S23 is larger than a button size (S24). It is assumed in that one pitch is set to 0.01 mm and the button size (button diameter) is 20 mm, for example. By this point in time, sewing has advanced by 90 pitches based on the data row having data number 4 and 90 pitches based on the data row having data number 5. Therefore, as compared to the position of the work cloth prior to first sewing based on the data row having data number 4, which is the first data row used in the repeated processing, the work cloth has moved only by 180 pitches. This means that in calculation, the work cloth has moved by 1.8 mm. Therefore, the value calculated at step S23 may come close to 1.8 mm, even including various errors (an error in stitch formation, an error in image processing, etc.). In such a case, the movement amount of the work cloth is not determined to exceed the button size (NO at S24). Consequently, the value of the second pointer P2 is stored as the first pointer P1, to make the first pointer P1 to indicate the first data row in the repetitive data rows (S25). More specifically, the first pointer P1 is set to 4 again (P1=4). Then, the processing returns to step S15.

As the first pointer P1 is 4 (P1=4), the work cloth is fed to a feed position specified by the feed pitch included in the data row indicated by the first pointer P1 (S15). Then, the sewing needle 16 is moved to a swinging position specified by the needle bar swinging pitch included in the data row indicated by the first pointer P1 (S116). As shown in FIG. 7, the feed pitch is −90 and the needle bar swinging pitch is −175 for the data row having data number 4, so that the work cloth is fed by as much as −90. Because the previous F coordinate of the needle drop point is 288,the current F coordinate is determined as 378. Therefore, the coordinates of a needle drop point in the FZ coordinate system on the work cloth are determined as (378, −175). Further, the drive shaft 51 is rotating (S17), so that the formation of one stitch is awaited (S18). The loop flag of the data row having data number 4 is not 2 (NO at S19), and the data row is not the last data row (NO at S20). Therefore, after the first pointer P1 is set to 5 (P1=5) (S21), the processing returns to step S12.

The first pointer P1 is 5 (P1=5) and as shown in FIG. 7, the loop flag of the data row having data number 5 is 2,that is, not 1 (NO at S12). Accordingly, the work cloth is fed to a feed position specified by the feed pitch included in the data row indicated by the first pointer P1 (S15), and the sewing needle 16 is moved to a swinging position specified by the needle bar swinging pitch included in the data row indicated by the first pointer P1 (S16). As shown in FIG. 7, the feed pitch is −90 and the needle bar swinging pitch is −175 for the data row having data number 5, so that the work cloth is fed by as much as −90. Because the previous F coordinate of the needle drop point is 378,the current F coordinate is determined as 468. Therefore, the coordinates of a needle drop point in the FZ coordinate system on the work cloth are determined as (468, −175). Further, the drive shaft 51 is rotating (S17), so that the formation of one stitch is awaited (S18).

The loop flag of the data row having data number 5 is 2 (YES at S19). Therefore, an image of the work cloth is captured by the image sensor 90 and the obtained image is stored as the second image in the second image storage area 643 (S22). Then, a movement amount of the work cloth is calculated (S23). A determination is made as to whether the calculated movement amount is larger than the button size (S24). By this point in time, as compared to the position of the work cloth prior to first sewing based on the data row having data number 4, the work cloth has moved by 360 pitches. Therefore, the movement amount is obtained as 3.6 mm, which is not determined to be larger than the button size of 20 mm (NO at S24). Consequently, the value of the second pointer P2 is stored as the first pointer P1, to make the first pointer P1 to indicate the first data row in the repetitive data rows (S25). More specifically, the first pointer P1 is set to 4 again (P1=4). Then, the processing returns to step S15.

By thus repeating the processing for the data rows with data numbers 4 and 5, the group of stitches 110 (the portion drawn as the thicker line) shown in FIG. 9 is formed. When the processing for the data rows having data numbers 4 and 5 has been repeated 12 times, sewing on the work cloth has advanced by as much as 2160 pitches. In calculation, the work cloth has been moved by 21.6 (mm) (2160×0.01=21.6). At this point, as shown in FIG. 13, the FZ coordinates of the needle drop point on the work cloth are (2268, −175). Therefore, after a stitch is formed based on the data row having data number 5 in the 12 th round of the processing, it is determined that the movement amount of the work cloth is larger than the button size (YES at S24). Because the data row of data number 5 is not the last data row, (NO at S20), the first pointer P1 is incremented to 6 (P1=6) (S21). Then, the processing returns to step S12.

As shown in FIG. 7, the loop flag of the data row having data number 6, which is indicated by the first pointer P1, is 0 and not 1 (NO at S12). Accordingly, the work cloth is fed to a feed position specified by the feed pitch included in the data row indicated by the first pointer P1 (S15), and the sewing needle 16 is moved to a swinging position specified by the needle bar swinging pitch included in the data row indicated by the first pointer P1 (S16). As shown in FIG. 7, the feed pitch is 0 and the needle bar swinging pitch is −150 for the data row having data number 6. Accordingly, the work cloth is not fed and the needle is swung by as much as −150. This movement results in a needle drop point at the coordinates (2268, −150) in the FZ coordinate system on the work cloth. Further, the drive shaft 51 is rotating (S17), so that the formation of one stitch is awaited (S18). The loop flag of the data row having data number 6 is not 2 (NO at S19) and the data row is not the last data row (NO at S20). Therefore, after the first pointer P1 is set to 7 (P1=7) (S21), the processing returns to step S12.

As shown in FIG. 7, the loop flag of the data row having data number 7, which is indicated by the first pointer P1, is 1 (YES at S12). Therefore, the repeated processing is started again. More specifically, similar to the repeated processing for the data rows with data numbers 4 and 5 described above, the processing for the data rows with data numbers 7 and 8 is repeated until the button size is exceeded by the movement amount of the work cloth (YES at S24). Then, the processing proceeds to step S20 to end the repetition.

Such processing is repeated until the processing on the last data row of the buttonhole sewing data is completed (YES at S20), whereupon the buttonhole sewing processing ends. At this point in time, the buttonhole stitch is finished. Then, the processing returns to the main processing shown in FIG. 10, and the main processing also ends.

As described above, the sewing machine of the present embodiment is equipped with the image sensor 90. By capturing an image of a button with the image sensor 90, a diameter of the button can be calculated. Then, a buttonhole having an appropriate size for the calculated diameter of the button can be sewn. Therefore, the user of the sewing machine 1 can make the buttonhole having a length that fits the button, with a simple operation of giving an instruction of capturing the image of the button.

Further, an amount of movement of a work cloth can be calculated by comparing a first image that is captured before sewing in a longitudinal direction of the buttonhole is started and a second image that is captured during sewing in the longitudinal direction. In other words, a sewn length in the longitudinal direction of the buttonhole can be calculated. Then, sewing can be continued until the movement amount of the work cloth is larger than the diameter of the button. Therefore, sewing can be performed in the longitudinal direction of the buttonhole as long as the diameter of the button. Therefore, the buttonhole having a length of the diameter of the button can be formed.

It should be noted that the sewing machine according to the present disclosure is not limited to the sewing machine 1 described in the above embodiment, and of course the sewing machine 1 can be modified variously. In the above embodiment, for example, a diameter of a button (button size) is taken as a length of a buttonhole through which the button can be inserted (hereinafter referred to as a "possible hole length"). Alternatively, a length obtained by adding a thickness of the button to the diameter can be taken as the possible hole length.

Further, in the above embodiment, an movement amount of the work cloth is taken as a sewn length in the longitudinal direction of the buttonhole, and compared to the diameter of the button (button size). The value to be taken as the sewn length in the longitudinal direction of the buttonhole, however, may not necessarily be the movement amount calculated on the basis of the first and second images of the work cloth. A description will be given below of a modified embodiment in which images of the buttonhole foot 300 is used (see FIG. 4).

As shown in FIG. 4, the holding portion 31 has a mark 310. The mark 310 is originally provided to enable appropriate positioning of the work cloth, by aligning the mark 310 with a mark drawn on the work cloth to indicate the position and length of the buttonhole. During the sewing of a buttonhole, the holding portion 31 moves integrally with the work cloth, so that an amount of movement of the mark 310 on the holding member 31, in place of the movement amount of the work cloth, may be compared to the button size. More specifically, images of the holding member 31 may be captured as the first and second images, the mark 310 may be extracted at step S23 of the buttonhole sewing processing shown in FIG. 11, and the movement amount of the mark may be calculated. Then, at step S24, the calculated movement amount of the mark 310, that is, the movement amount of the holding member 31 may be compared to the button size. Further, the position and the shape of the mark 310 are not limited to those shown in FIG. 4, but may be modified arbitrarily.

Further, although a button size is calculated from a button image of an actual button, the button size may not necessarily be calculated from the button image. For example, in place of the processing at steps S4 and S5, a numeral of the diameter of the button may be entered by the user by using the LCD 10 and the touch panel 26. It is thus possible to sew a buttonhole even when an actual button is not at hand. Further, in a case where there is a plurality of available buttonhole stitches for the same shape of a button, it is only necessary for the user to enter a button size once, thus saving the user the trouble of entering the diameter several times.

Further, in the above-described embodiment, the calculated button size is displayed on the LCD 10 thereby notifying the user of the button size. The user, however, may not always be notified of the button size. In other words, the processing at step S6 of the main processing shown in FIG. 10.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine comprising:

an image capturing device that captures an image;

a sewing device that sews a buttonhole having a length in accordance with a shape of a button, based on an image of the button captured by the image capturing device, wherein:

the sewing device sews the buttonhole having the length obtained by increasing or decreasing a diameter of the button, the sewing device comprises:

a needle bar to which a sewing needle is capable of being attached;

a moving device that causes a movement of a sewing target relative to the sewing needle;

a moving member that moves with the sewing target relative to the needle bar; and a control device that controls the moving device, the image capturing device captures an image of the moving member, the control device controls the moving device to change at least one of a direction and a distance of the movement of the sewing target relative to the needle bar based on the captured image of the moving member after sewing of the buttonhole has started, the moving member has a mark provided thereon that changes a position in accordance with the movement of the sewing target relative to the needle bar, and the control device controls the moving device to change at least one of the direction and the distance of the movement of the sewing target relative to the needle bar, based on the captured image of the moving member with the mark after sewing of the buttonhole has started.

2. The sewing machine according to claim 1, wherein the moving member is included in a buttonhole foot that holds the sewing target while the buttonhole is sewn.

3. The sewing machine according to claim 1, further comprising:

a pattern selecting device that selects one of stitch patterns including buttonhole stitches and other stitch patterns;

wherein, in a case where a buttonhole stitch is selected, the sewing device sews the buttonhole having the length in accordance with the shape of the button with the buttonhole stitch, based on the captured image of the button.

4. A non-transitory computer-readable medium storing a computer-executable program for sewing a buttonhole with a sewing machine, the sewing machine including an image capturing device and a sewing device, wherein the sewing device includes a needle bar to which a sewing needle is capable of being attached; a moving device that causes a movement of a sewing target relative to the sewing needle; a moving member that moves with the sewing target relative to the needle bar; and a control device that controls the moving device, the computer-executable program comprising instructions for:

capturing an image of a button with the image capturing device; and sewing a buttonhole having a length in accordance with a shape of the button with the sewing device, based on the captured image of the button, wherein:

the sewing device sews the buttonhole having the length obtained by increasing or decreasing a diameter of the button, the image capturing device captures an image of the moving member, the control device controls the moving device to change at least one of a direction and a distance of the movement of the sewing target relative to the needle bar based on the captured image of the moving member after sewing of the buttonhole has started, the moving member has a mark provided thereon that changes a position in accordance with the movement of the sewing target relative to the needle bar, and the control device controls the moving device to change at least one of the direction and the distance of the movement of the sewing target relative to the needle bar, based on the captured image of the moving member with the mark after sewing of the buttonhole has started.

* * * * *